US009508514B2

(12) United States Patent
Ohda et al.

(10) Patent No.: US 9,508,514 B2
(45) Date of Patent: Nov. 29, 2016

(54) SWITCHGEAR OPERATING MECHANISM

(71) Applicant: Kabushiki Kaisha Toshiba, Tokyo (JP)

(72) Inventors: Yoshiaki Ohda, Kanagawa (JP); Tadashi Koshizuka, Saitama (JP); Kazuhisa Kanaya, Kanagawa (JP); Masayuki Ando, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/968,128

(22) Filed: Dec. 14, 2015

(65) Prior Publication Data

US 2016/0099123 A1 Apr. 7, 2016

Related U.S. Application Data

(63) Continuation of application No. PCT/JP2014/081562, filed on Nov. 28, 2014.

(30) Foreign Application Priority Data

Feb. 27, 2014 (JP) ..... 2014-036531

(51) Int. Cl.
*H01H 33/02* (2006.01)
*H01H 50/30* (2006.01)
(Continued)

(52) U.S. Cl.
CPC ..... *H01H 50/305* (2013.01); *H01F 7/08* (2013.01); *H01H 33/38* (2013.01); *H01H 33/666* (2013.01); *H01H 50/32* (2013.01); *H01H 50/36* (2013.01); *H01H 50/74* (2013.01)

(58) Field of Classification Search
CPC ..... H01H 51/01
USPC ..... 218/120, 140–141
See application file for complete search history.

(56) References Cited

U.S. PATENT DOCUMENTS 3,471,814 A * 10/1969 Burdett ..... H01F 7/1638 218/141
3,513,420 A * 5/1970 Griffith ..... H01H 3/28 335/164

(Continued)

FOREIGN PATENT DOCUMENTS

JP H09-7468 A 1/1997
JP 2000-268683 A 9/2000

(Continued)

OTHER PUBLICATIONS

International Search Report and Written Opinion issued in related PCT Application No. PCT/JP2014/081562 mailed February 24, 2015, 7 pages (with translation.).

*Primary Examiner* — Alexander Talpalatski
(74) *Attorney, Agent, or Firm* — Baker Botts L.L.P.

(57) ABSTRACT

An electromagnetic rebound mechanism unit and a magnetic latch unit are fixedly installed between a switchgear and a spring drive unit by virtue of a rebound fixing member and a fixing yoke. The electromagnetic rebound mechanism unit includes a rebound coil fixedly secured to the rebound fixing member, a reinforcing plate fixedly secured to a movable shaft and a rebound ring fixedly secured to the reinforcing plate. The magnetic latch unit includes a permanent magnet fixedly secured to the rebound fixing member, a latch ring fixedly secured to the permanent magnet and a movable yoke fixedly secured to the movable shaft. The spring drive unit includes a support frame, a spring retaining plate, a circuit-opening spring, a damper unit, and first and second electromagnetic solenoids.

6 Claims, 9 Drawing Sheets

(51) Int. Cl.

| | |
|---|---|
| ***H01H 33/38*** | (2006.01) |
| ***H01H 33/666*** | (2006.01) |
| ***H01F 7/08*** | (2006.01) |
| ***H01H 50/32*** | (2006.01) |
| ***H01H 50/36*** | (2006.01) |
| ***H01H 50/74*** | (2006.01) |

(56) References Cited

U.S. PATENT DOCUMENTS

| | | | | |
|---|---|---|---|---|
| 3,748,418 | A * | 7/1973 | Kawasaki | H01H 33/285 200/82 B |
| 6,020,567 | A * | 2/2000 | Ishikawa | H01H 3/28 218/120 |
| 6,066,999 | A * | 5/2000 | Pischinger | F01L 9/04 335/226 |
| 6,373,675 | B1 * | 4/2002 | Yamazaki | H01H 53/015 200/237 |
| 8,138,440 | B2 * | 3/2012 | Onufriyenko | H01H 73/045 218/154 |
| 8,912,871 | B2 * | 12/2014 | Lauraire | H01H 3/28 218/120 |
| 9,368,294 | B2 * | 6/2016 | Ohtsuka | H01F 7/124 |
| 2010/0006544 | A1 * | 1/2010 | Onufriyenko | H01H 73/045 218/154 |
| 2013/0214886 | A1 * | 8/2013 | Ohtsuka | H01F 7/124 335/189 |

FOREIGN PATENT DOCUMENTS

| | | | |
|---|---|---|---|
| JP | 2001-210195 | A | 8/2001 |
| JP | 2002-124162 | A | 4/2002 |
| JP | 2004-139805 | A | 5/2004 |
| JP | 2004-342552 | A | 12/2004 |
| JP | 2005-078971 | A | 3/2005 |
| JP | 2006-236773 | A | 9/2006 |
| JP | 2015-043656 | A | 3/2015 |
| JP | 2015-056239 | A | 3/2015 |
| JP | 2015-060777 | A | 3/2015 |
| JP | 2015-060778 | A | 3/2015 |

* cited by examiner

SWITCHGEAR OPERATING MECHANISM

CROSS-REFERENCE TO RELATED APPLICATIONS

This application is a Continuation of PCT Application No. PCT/JP2014/081562, filed on Nov. 28, 2014, and claims priority to Japanese Patent Application No. 2014-036531, filed on Feb. 27, 2014, the entire contents of both of which are incorporated herein by reference.

TECHNICAL FIELD

Embodiments of the present disclosure relate to a switchgear operating mechanism that makes use of electromagnetic rebound drive which is fast in response speed and relatively long in stroke.

BACKGROUND

There have been proposed many switchgear operating mechanisms that make use of an electromagnetic rebound principle. However, most of the operating mechanisms are applied to vacuum valves. Thus, the displacement of the operating mechanism corresponding to the stroke of a contact point unit, which depends on a voltage class, is relatively short, e.g., ten-odd millimeters or less.

Furthermore, in order to increase the response speed from the issuance of an electrode opening command to the start of an operation, there has been proposed an operating mechanism which includes a movable coil in addition to a fixed coil of an electromagnetic rebound mechanism and which operates with a small amount electric energy and at a high response speed.

For example, Patent Document 1 and Patent Document 2 disclose an operating mechanism which includes a switch unit, a movable coil, an electrode-opening-purpose fixed coil, an electrode-closing-purpose fixed coil and a magnetic latch mechanism. The switch unit includes a fixed electrode and a movable electrode which can be brought into contact or out of contact with each other. The movable coil is a coil fixed to an intermediate portion of a movable shaft connected to the movable electrode. The electrode-opening-purpose fixed coil is a coil which is disposed at the side of the movable electrode in the axial direction of the movable coil and which is configured to rebound between itself and the movable coil. The electrode-closing-purpose fixed coil is a coil which fixed to the opposite side of the electrode-opening-purpose fixed coil from the movable coil and which is configured to rebound between itself and the movable coil. The magnetic latch mechanism is a mechanism which makes use of a magnetic attraction force of a permanent magnet fixed to an end portion of the movable shaft.

The operating mechanism using such a magnetic rebound mechanism is characterized in that it is possible to obtain a high response and a high speed. However, in contrast to the high response and the high speed, the acceleration acting in the movable unit becomes larger. It is therefore necessary to make the movable unit relatively strong.

In order to comply with such a need, Patent Document 3 proposes an operating mechanism in which a coil is fixed to a movable unit. In this prior art, there is proposed a method of bonding and reinforcing a movable coil with a resin mold or a varnish. There is also proposed a method of installing a movable coil within a nonmagnetic case to increase the rigidity thereof.

Furthermore, the electromagnetic rebound mechanism applied to a vacuum circuit breaker needs to have a function of maintaining a contact point position within a vacuum valve in an open circuit state or a closed circuit state. However, the responsiveness of such a position maintaining mechanism affects the response time of the entirety of the switchgear which makes use of the electromagnetic rebound mechanism. To cope with this, a magnetic latch mechanism which does not require a mechanical holding and releasing operation is proposed in Patent Document 4 as well as Patent Document 1 and Patent Document 2.

In Patent Document 4, an operating rod is held so that the operating rod can move in such a direction as to bring a movable contact member into contact or out of contact with a fixed contact member. Furthermore, an elastic body biases the operating rod against a movable member whose movement amount is restricted. A permanent magnet for holding and attractingly driving the movable member is installed and an operating electromagnet is fixed to the movable member. A driving-purpose spring is disposed in an end portion of the movable member and is used as a drive source in a circuit-opening operation direction.

Furthermore, a technique of properly restraining the high-speed operation of the electromagnetic rebound mechanism is disclosed in Patent Document 5. In this technique, similar to Patent Document 1 and Patent Document 2, fixed coils are disposed at the electrode-opening-position side and the electrode-closing-position side. For example, in an electrode-opening operation, a pulse current flows through a contact-point-side fixed coil. A movable contact point and a movable unit operate in an electrode-opening direction. Immediately before the end of the electrode-opening operation, a pulse current flows through another fixed coil, thereby generating an electromagnetic rebound force so as to restrain the operation. Thus, a brake force acts on the movable unit, whereby the movable unit as a whole stops.

PRIOR TECHNICAL LITERATURE

Patent Document

Patent Document 1: JP2004-139805 A
Patent Document 2: JP2005-78971 A
Patent Document 3: JP2002-124162 A
Patent Document 4: JP2000-268683 A
Patent Document 5: JPH9-7468 A In the electromagnetic rebound mechanism recited in Patent Documents 1 and 2, in order to efficiently use electric energy, the movable coil needs to be made of a good conductor such as copper. However, copper has a large specific gravity. Thus, the entirety of the movable unit including the movable coil becomes heavy. This may be a cause of the reduction in the responsiveness or the speed.

Furthermore, when the fixed coil and the movable coil are appropriately moved away from each other, the electromagnetic rebound force acting on the movable coil is sharply weakened. If an external force such as a friction force acts, there is a possibility that the speed is reduced during the operation. For that reason, it is difficult to apply the electromagnetic rebound mechanism to a switchgear operating mechanism having a relatively long distance (stroke).

Moreover, in order for a movable member of a magnetic latch to obtain a holding force, there is a need to somewhat increase the contact area between the movable member and a yoke. It is also necessary to hold the movable member in an open state and a closed state. Thus, the movable member becomes thick and long. The movable unit as a whole becomes heavy. The responsiveness and the speed decrease.

In the operating mechanism recited in Patent Document 3, for the purpose of improving the strength of the movable coil, the movable coil is strengthened by the bonding of a resin mold or the like or is covered with a nonmagnetic case. This may be a cause of the increase in the movable unit weight and the reduction in the responsiveness and the speed.

In the operating mechanism recited in Patent Document 4, operation electromagnet windings are fixedly secured to the movable member. Thus, the weight of the movable unit increases and the responsiveness and the speed decrease. Furthermore, the operating mechanism is not provided with a brake device for stopping the circuit-opening operation. Thus, the impulsive force generated when stopping the operation becomes large. This may be a cause of the reduction in the strength of individual parts.

In the case where the stroke is relatively long, in order to perform a circuit-closing operation, the electromagnetic force of the operation electromagnet needs to be made large. The reason is as follows. In the circuit-closing operation, the entirety of the movable unit needs to be moved in a circuit-closing direction while compressing a circuit-opening spring. It is because at the initial stage of the circuit-closing operation, the magnetic attraction surface is separated and the electromagnetic force is made small. In order to make large the electromagnetic force in the circuit-closing operation, it is necessary to wind a larger number of operation electromagnet windings. By doing so, the weight of the movable unit further increases. This may be a cause of the reduction in the responsiveness and the speed during the circuit-opening operation.

Furthermore, in Patent Document 5, during the latter half of the circuit-opening operation, a current flows through the fixed coil existing at the electrode-closing-position side, thereby applying an electromagnetic rebound force to the movable coil. The circuit-opening operation is stopped by using the electromagnetic rebound force as a brake force of the movable coil. This reduces the impulsive force generated during the stoppage. However, this poses a problem in that a large amount of electric energy is required in the circuit-opening operation and the drive power source becomes large in size.

SUMMARY

Embodiments of the present disclosure have been proposed to solve the aforementioned problems inherent in the prior art. It is an object of the present disclosure to provide a switchgear operating mechanism which is capable of reducing the weight of a movable unit of the operating mechanism, reducing the electric energy required in driving the movable unit, obtaining a high response and a high speed with a relatively long stroke, reducing the impulsive force generated when stopping a circuit-opening operation, and enjoying high reliability.

A switchgear operating mechanism according to embodiments of the present disclosure is proposed to accomplish the above object. (a) The switchgear operating mechanism operates a movable shaft extending from a movable electrode of a switchgear to thereby bring the movable electrode into contact or out of contact with a fixed electrode. (b) The switchgear operating mechanism includes: an electromagnetic rebound mechanism unit; a magnetic latch unit; and a spring drive unit. (c) The electromagnetic rebound mechanism unit and the magnetic latch unit are fixedly installed between the switchgear and the spring drive unit by virtue of a fixing member. (d) The electromagnetic rebound mechanism unit includes a rebound coil fixedly secured to the fixing member, a reinforcing plate fixedly secured to the movable shaft and a rebound ring fixedly secured to the reinforcing plate. (e) The magnetic latch unit includes a permanent magnet fixedly secured to the fixing member, a latch ring fixedly secured to the permanent magnet and a movable yoke fixedly secured to the movable shaft. (f) The spring drive unit includes a support frame fixedly installed on the fixing member, a spring retaining plate fixedly secured to an end portion of the movable shaft, a circuit-opening spring disposed between the spring retaining plate and the support frame so as to surround the movable shaft, a damper unit fixedly installed on the support frame and an electromagnetic solenoid fixedly installed on the support frame.

DETAILED DESCRIPTION

First Embodiment

Figure 1:
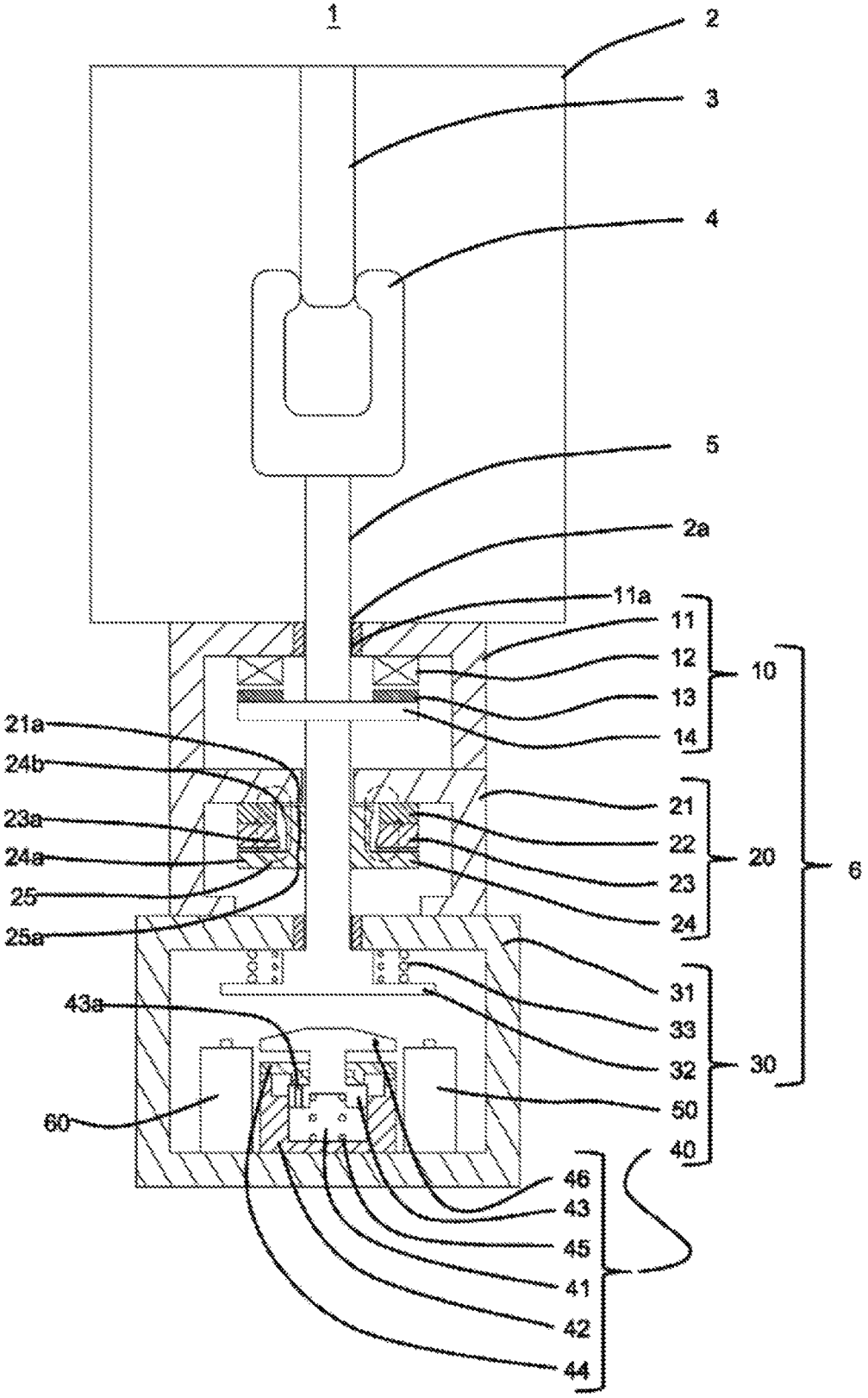
FIG. 1 is a sectional view illustrating a closed circuit state of a switchgear operating mechanism according to a first embodiment.

A switchgear operating mechanism according to a first embodiment will be described with reference to FIGS. 1 to 8.

[Configuration]

The configuration of the present embodiment will be described with reference to FIG. 1. The present embodiment is directed to an operating mechanism 6 which is connected to a switchgear 1 to operate the opening and closing of the switchgear 1.

[Switchgear]

First, the configuration of the switchgear 1 will be described. The switchgear 1 includes a pressure container 2, a fixed electrode 3, a movable electrode 4 and a movable shaft 5. The pressure container 2 is an airtight container which retains an insulating gas. The fixed electrode 3 is an electrically conductive member of a circular columnar shape. One end of the fixed electrode 3 is fixed to the inside of the pressure container 2. The movable electrode 4 is an electrically conductive member of a cylindrical shape having a lower bottom surface. The upper open end of the movable electrode 4 is disposed so as to face the fixed electrode 3.

The movable shaft 5 is an electrically conductive member of a circular columnar shape. One end of the movable shaft 5 is fixed to the lower bottom portion of the movable electrode 4. The movable shaft 5 is coaxial with the fixed electrode 3. A portion of the movable shaft 5 extends outward from the movable electrode 4 through an airtight hole 2*a* of the pressure container 2. The movable shaft 5 is moved in the axial direction by the below-described operating mechanism 6. Thus, the movable shaft 5 moves the movable electrode 4, thereby bringing the open end of the movable electrode 4 into contact or out of contact with the other end of the fixed electrode 3.

[Operating Mechanism]

The operating mechanism 6 is fixed to the outer surface of the pressure container 2 from which the movable shaft 5 extends. The operating mechanism 6 is a mechanism which drives the movable shaft 5 and the movable electrode 4. The operating mechanism 6 includes an electromagnetic rebound mechanism unit 10, a magnetic latch unit 20 and a spring drive unit 30. A rebound fixing member 11 of the electromagnetic rebound mechanism unit 10 and a fixing yoke 21 of the magnetic latch unit 20 are members which belong to the concept of a fixing member.

[Electromagnetic Rebound Mechanism Unit]

The electromagnetic rebound mechanism unit 10 includes a rebound fixing member 11, a rebound coil 12, a rebound ring 13 and a reinforcing plate 14. The rebound fixing member 11 is made of a nonmagnetic material and is a tubular fixing member having an upper bottom portion. The upper bottom portion of the rebound fixing member 11 is fixed to the pressure container 2. The rebound fixing member 11 slidably supports the movable shaft 5 inserted into a sliding hole 11*a* of the upper bottom portion.

The rebound coil 12 is an annular coil and is fixed to the upper bottom portion of the rebound fixing member 11 so as to surround the movable shaft 5. The reinforcing plate 14 is formed of a disc-shaped light metal and is fixed to the movable shaft 5. The rebound ring 13 is an annular plate-shaped member made of a highly conductive material and is fixed to the side of the reinforcing plate 14 that faces the rebound coil 12.

[Magnetic Latch Unit]

The magnetic latch unit 20 includes a fixing yoke 21, a permanent magnet 22, a latch ring 23 and a movable yoke 24.

(Fixing Yoke)

The fixing yoke 21 is made of a magnetic material and is a tubular fixing member having an upper bottom portion. The fixing yoke 21 is fixed so that the upper bottom portion thereof closes the opening of the rebound fixing member 11. The movable shaft 5 is inserted into a hole of the upper bottom portion.

(Permanent Magnet)

The permanent magnet 22 is an annular magnet having a rectangular cross section and is fixedly secured to the upper bottom portion of the fixing yoke 21 so as to surround the movable shaft 5. The axially opposite end surfaces of the permanent magnet 22 are respectively magnetized with an N-pole and an S-pole.

(Latch Ring)

The latch ring 23 is formed by a magnetic material in an annular shape having a rectangular cross section and is fixedly secured to the permanent magnet 22 so as to surround the movable shaft 5. An inner edge portion 23*a* of a lower end of the latch ring 23 protrudes inward so that the inner diameter thereof becomes smaller.

(Movable Yoke)

The movable yoke 24 is made of a magnetic material and has a hat-shaped cross section. That is to say, the movable yoke 24 includes a cylindrical head top portion 24*b* and a brim portion 24*a* annularly protruding from the periphery of the end portion thereof. By increasing the diameter of the head top portion 24*b*, the area of the surface of the head top portion 24*b* facing the inner surface of the fixing yoke 21 is enlarged. The edge portion of the head top portion 24*b* protrudes outward. The movable shaft 5 is inserted through the movable yoke 24 and is fixedly secured to the movable yoke 24. Along with the movement of the movable shaft 5, the head top portion 24*b* of the movable yoke 24 is moved into and out of the permanent magnet 22 and the latch ring 23.

Figure 2:
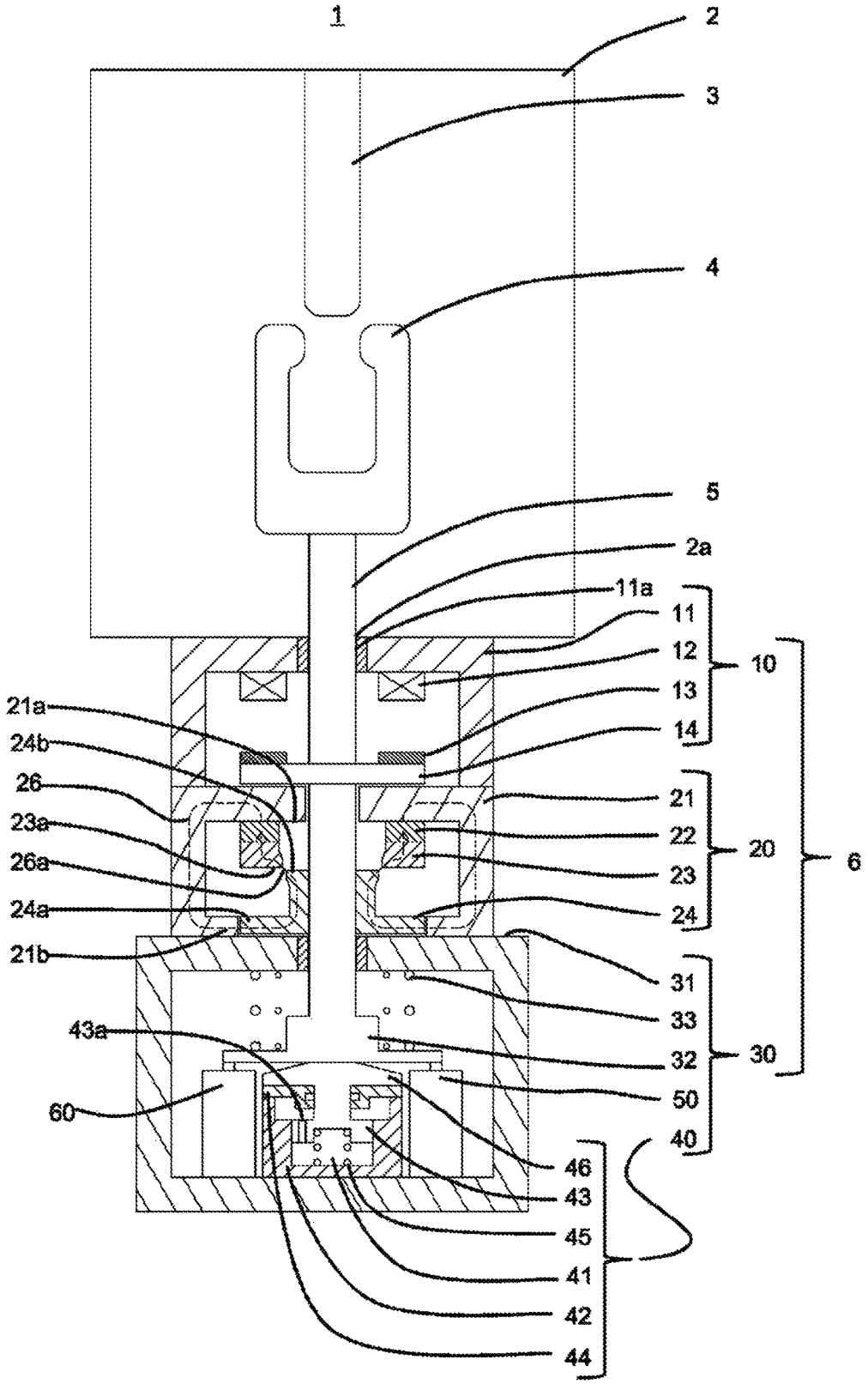
FIG. 2 is a sectional view illustrating an open circuit state of the switchgear operating mechanism according to the first embodiment.

An annular protrusion portion 21*b* is formed at the open end of the lower portion of the fixing yoke 21 so that the inner diameter of the opening becomes small. As illustrated in FIG. 2, the brim portion 24*a* of the movable yoke 24 is inserted into inside of the protrusion portion 21*b*. The inner surface of the upper bottom portion of the fixing yoke 21, which faces the head top portion 24*b* of the movable yoke 24, is an attraction surface 21*a* that attracts the movable yoke 24 with a magnetic force. The clearance between the head top portion 24*b* and the attraction surface 21*a* constitutes an air gap 25*a*. Furthermore, as illustrated in FIG. 2, when the brim portion 24*a* of the movable yoke 24 is inserted into inside of the protrusion portion 21*b*, the clearance between the edge portion 23*a* of the latch ring 23 and the head top portion 24*b* constitutes an air gap 26*a*.

(Closed-Circuit-Side Magnetic Circuit)

Hereinafter, the state in which the fixed electrode 3 and the movable electrode 4 make contact with each other to close the circuit of the switchgear 1 as illustrated in FIG. 1 will be referred to as a closed circuit state. In the closed circuit state, the attraction surface 21*a* of the fixing yoke 21 and the head top portion 24*b* of the movable yoke 24 come close to each other, and the latch ring 23 and the brim portion 24*a* of the movable yoke 24 come close to each other. Thus, as indicated by broken lines, a closed-circuit-side magnetic circuit 25 is formed by the members which have come close to each other. Consequently, the movable yoke 24 is attracted toward the latch ring 23 by the magnetic force of the permanent magnet 22. Since the area of the upper surface of the head top portion 24*b* is enlarged, it may be possible to obtain a strong magnetic attraction force.

(Open-Circuit-Side Magnetic Circuit)

Furthermore, the state in which the fixed electrode 3 and the movable electrode 4 are separated from each other to open the circuit of the switchgear 1 as illustrated in FIG. 2 will be referred to as an open circuit state. In the open circuit state, the protrusion portion 21*b* of the fixing yoke 21 and the brim portion 24*a* come close to each other, and the edge portion 23*a* of the latch ring 23 and the edge portion of the head top portion 24*b* of the movable yoke 24 come close to each other. Thus, as indicated by broken lines, an open-circuit-side magnetic circuit 26 is formed by the members which have come close to each other. Consequently, the movable yoke 24 is attracted toward the latch ring 23 by the magnetic force of the permanent magnet 22.

The edge portion 23*a* of the latch ring 23 protrudes inward and the edge portion of the head top portion 24*b* protrudes outward. It may therefore be possible to suppress the increase in the magnetic resistance caused by the enlargement of the air gap 26*a* and to secure the magnetic attraction force. However, the air gap 26*a* between the edge portion 23*a* of the latch ring 23 and the edge portion of the head top portion 24*b* illustrated in FIG. 2 is larger than the air gap 25*a* between the attraction surface 21*a* of the fixing yoke 21 and the head top portion 24*b* of the movable yoke 24 illustrated in FIG. 1. Thus, in the open circuit state illustrated in FIG. 2, as compared with the closed circuit state illustrated in FIG. 1, the magnetic resistance becomes larger and the magnetic attraction force becomes smaller.

[Spring Drive Unit]

The spring drive unit 30 includes a support frame 31, a spring retaining plate 32, a circuit-opening spring 33, a damper unit 40, a first electromagnetic solenoid 50 and a second electromagnetic solenoid 60.

(Support Frame)

The support frame 31 is a container made of a nonmagnetic material. The upper surface of the support frame 31 is fixed to the open end of the fixing yoke 21. The support frame 31 slidably supports the movable shaft 5 inserted into a sliding hole of the upper surface thereof.

(Spring Retaining Plate)

The spring retaining plate 32 is a member which includes a cylindrical head top portion and a brim portion annularly protruding from the periphery of the end portion thereof. The end portion of the movable shaft 5 existing within the support frame 31 is fixedly secured to the head top portion.

(Circuit-Opening Spring)

The circuit-opening spring 33 is disposed between the support frame 31 and the brim portion of the spring retaining plate 32 so as to surround the movable shaft 5. The circuit-opening spring 33 has a spring force which biases the movable shaft 5 in a circuit-opening direction at all times.

(Damper Unit)

The damper unit 40 includes hydraulic oil 41 as a fluid, a cylinder 42, a piston 43, a seal plate 44, a return spring 45 and a piston head 46. The cylinder 42 is fixedly installed on the portion of the support frame 31 existing in the extension direction of the movable shaft 5. The hydraulic oil 41 is filled in the internal space of the cylinder 42. The piston 43 is disposed within the cylinder 42 so that the piston 43 can slide in the coaxial direction with the movable shaft 5. The seal plate 44 is fixedly secured to the end portion of the cylinder 42 so as to hermetically seal the hydraulic oil 41 and to restrict the movable extent of the piston 43. The return spring 45 is disposed between the bottom portion of the cylinder 42 and the piston 43. The return spring 45 has a spring force which always biases the piston 43 in such a direction as to push the piston 43 toward the seal plate 44.

The piston head 46 is fixedly secured to the end portion of the piston 43 protruding outward from the cylinder 42. The piston head 46 and the seal plate 44 are configured to make contact with each other, when moved in a direction in which the return spring 45 is compressed, so as to restrict the movable extent of the piston 43. Furthermore, an speed-controlling/shock-absorbing orifice hole 43*a* is disposed in the piston 43. The orifice hole 43*a* opens and closes the communication between an internal space of the cylinder 42 within which the return spring 45 is accommodated and a space which exists below the seal plate 44.

When the movable electrode 4 is moved away from the fixed electrode 3 to perform a circuit-opening operation, the spring retaining plate 32 and the piston head 46 make contact with each other. If the piston 43 is pressed by the movable electrode 4 and is moved a predetermined distance, the piston head 46 and the seal plate 44 make contact with each other. Thus, the piston head 46, the spring retaining plate 32 and the movable shaft 5 are stopped.

In the present embodiment, when the switchgear 1 is in the closed circuit state, the magnetic attraction force Fmc of the magnetic latch unit 20 and the elastic force Fkc of the circuit-opening spring 33 are set to satisfy a relationship of Fmc>Fkc. Furthermore, when the switchgear 1 is in the open circuit state, the magnetic attraction force Fmo of the magnetic latch unit 20, the elastic force Fko of the circuit-opening spring 33 and the elastic force Fdo of the return spring 45 of the damper unit 40 are set to satisfy a relationship of Fko>(Fmo+Fdo).

(Electromagnetic Solenoid)

The electromagnetic solenoids 50 and 60 include a plurality of electromagnetic solenoids disposed around the damper unit 40 and are fixedly installed on the support frame 31. The electromagnetic solenoids 50 and 60 include a plurality of electromagnetic solenoids having different electromagnetic attraction characteristics.

Figure 4:
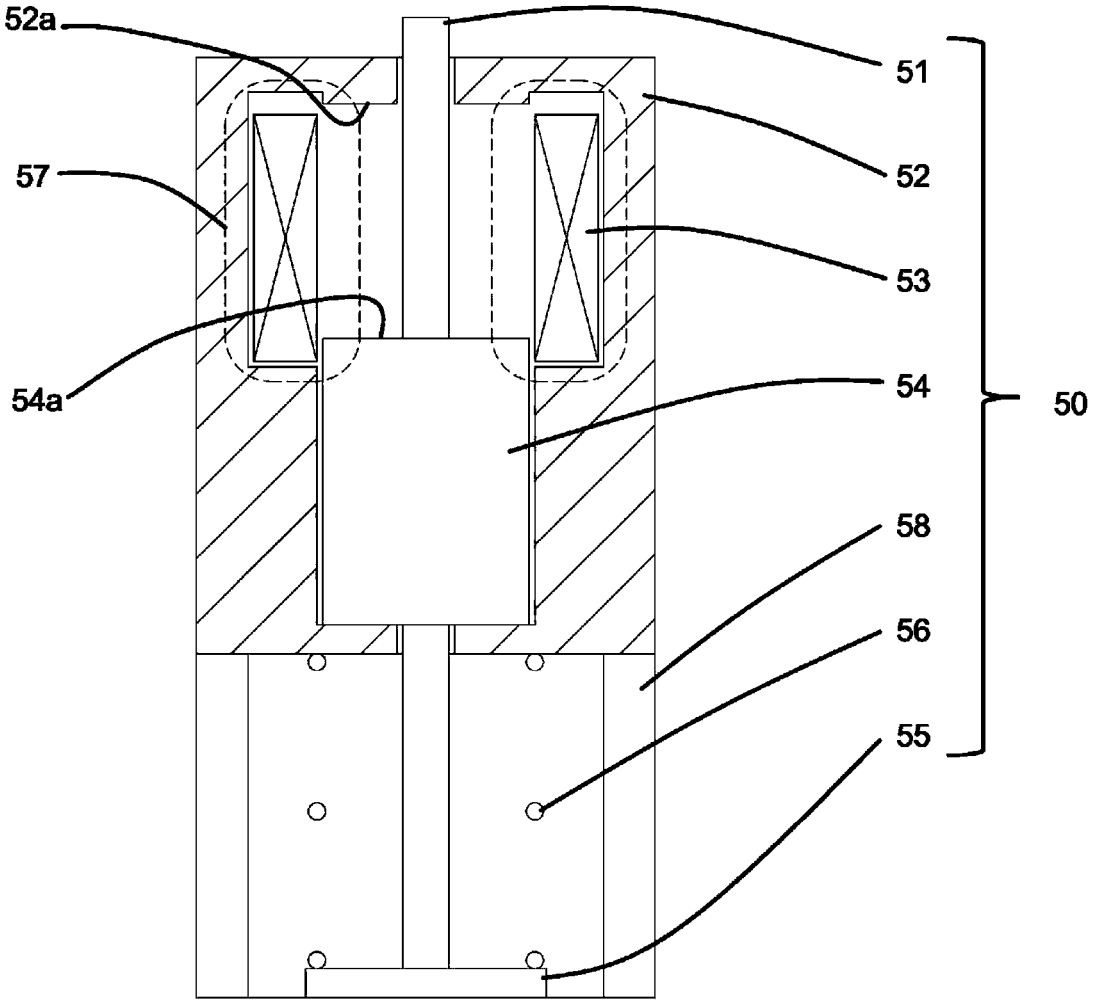
FIG. 4 is a sectional view illustrating a circuit-opening position of a first electromagnetic solenoid of the switchgear operating mechanism according to the first embodiment.
Figure 5:
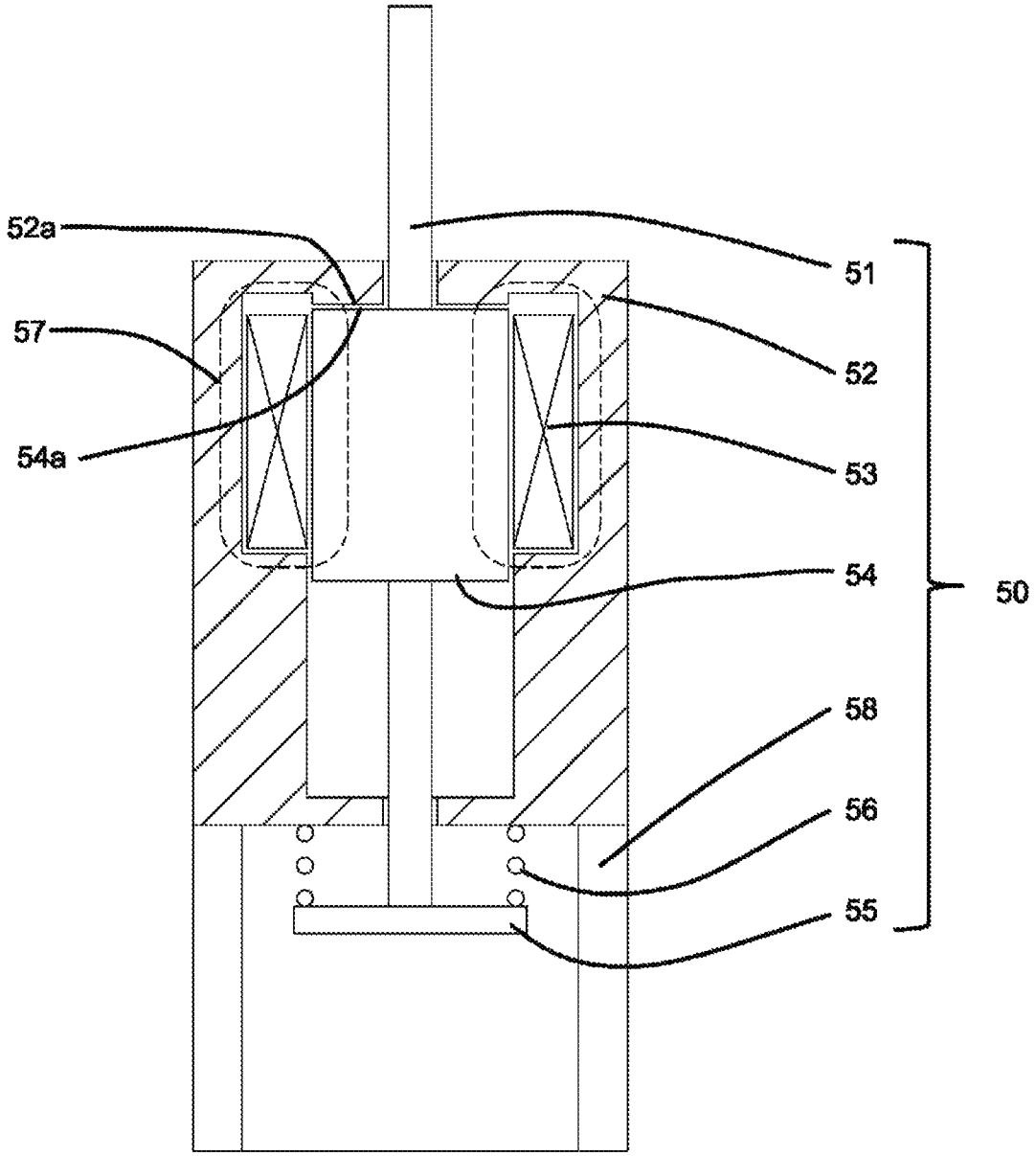
FIG. 5 is a sectional view illustrating a circuit-closing position of the first electromagnetic solenoid of the switchgear operating mechanism according to the first embodiment.

First, the first electromagnetic solenoid 50 as a representative electromagnetic solenoid is illustrated in FIGS. 4 and 5. FIG. 4 is a structural diagram illustrating the first electromagnetic solenoid 50 kept in a circuit-opening position. FIG. 5 is a structural diagram illustrating the first electromagnetic solenoid 50 kept in a circuit-closing position. The first electromagnetic solenoid 50 includes a plunger 51, a solenoid yoke 52, a solenoid coil 53, an armature 54, a spring rest 55, a return spring 56, and a support portion 58.

The solenoid yoke 52 is an external skeleton of the first electromagnetic solenoid 50 and is made of a magnetic material. The solenoid yoke 52 has an internal space. The solenoid coil 53 is disposed in an upper region of the internal space. The plunger 51 is a rod-shaped member disposed on a center axis of the solenoid yoke 52. The plunger 51 is inserted through a hole of the upper surface of the solenoid yoke 52. One end of the plunger 51 protrudes outward and makes contact with or moves away from the spring retaining plate 32. Furthermore, the armature 54 is fixedly secured to a central portion of the plunger 51.

The armature 54 is a cylindrical member made of a magnetic material. The armature 54 is accommodated within an accommodation portion formed in a central region of the internal space of the solenoid yoke 52 so that the armature 54 can move in the axial direction of the plunger 51. The outer diameter of the armature 54 is smaller than the inner diameter of the solenoid coil 53. The armature 54 is installed so as to move into and out of the solenoid coil 53.

Furthermore, the other end of the plunger 51 is inserted through a hole of the bottom surface of the solenoid yoke 52 so as to protrude outwards and is fixedly secured to the spring rest 55. The spring rest 55 is a disc-shaped member coaxial with the plunger 51. The return spring 56 is disposed between the spring rest 55 and the solenoid yoke 52 so as to surround the plunger 51. The return spring 56 has a spring force which biases the plunger 51 in such a direction as to move the plunger 51 toward the spring rest 55. Furthermore, the support portion 58 is a tubular member which accommodates the plunger 51 and the return spring 56. The upper end of the support portion 58 is fixedly secured to the lower end of the solenoid yoke 52. The lower end of the support portion 58 is fixedly installed on the inner bottom of the support frame 31.

When a current flows through the solenoid coil 53, the armature 54 of the first electromagnetic solenoid 50 is excited. As illustrated in FIG. 5, an upper attraction surface 54*a* of the armature 54 moves toward and makes contact with an attraction surface 52*a* of the solenoid yoke 52. Thereafter, the armature 54 stops. Magnetic paths 57 formed at this time are indicated by broken lines. When a current is not supplied, the armature 54 is moved to a pre-excitation position by the spring force of the return spring 56 as illustrated in FIG. 4.

Figure 6:
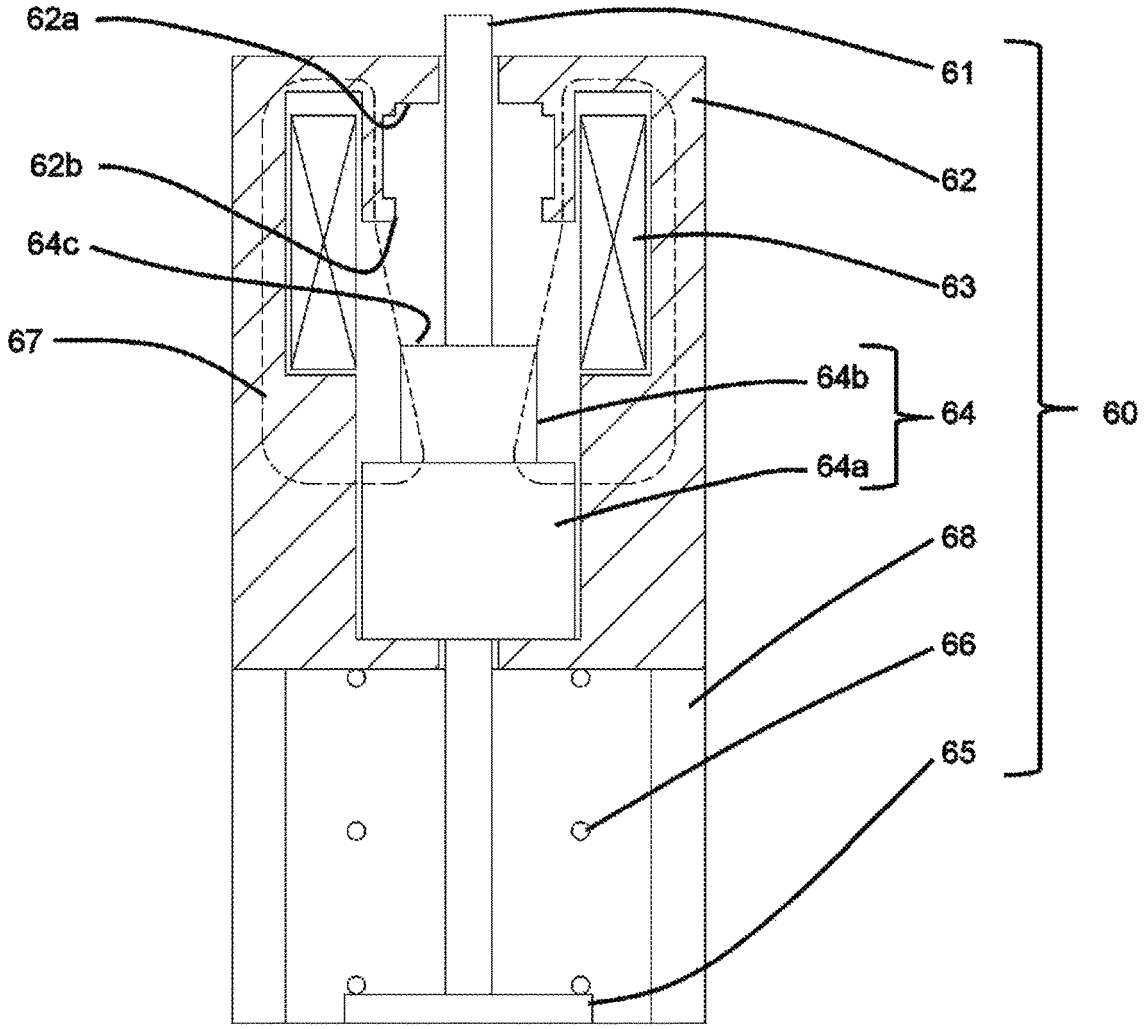
FIG. 6 is a sectional view illustrating a circuit-opening position of a second electromagnetic solenoid of the switchgear operating mechanism according to the first embodiment.
Figure 7:
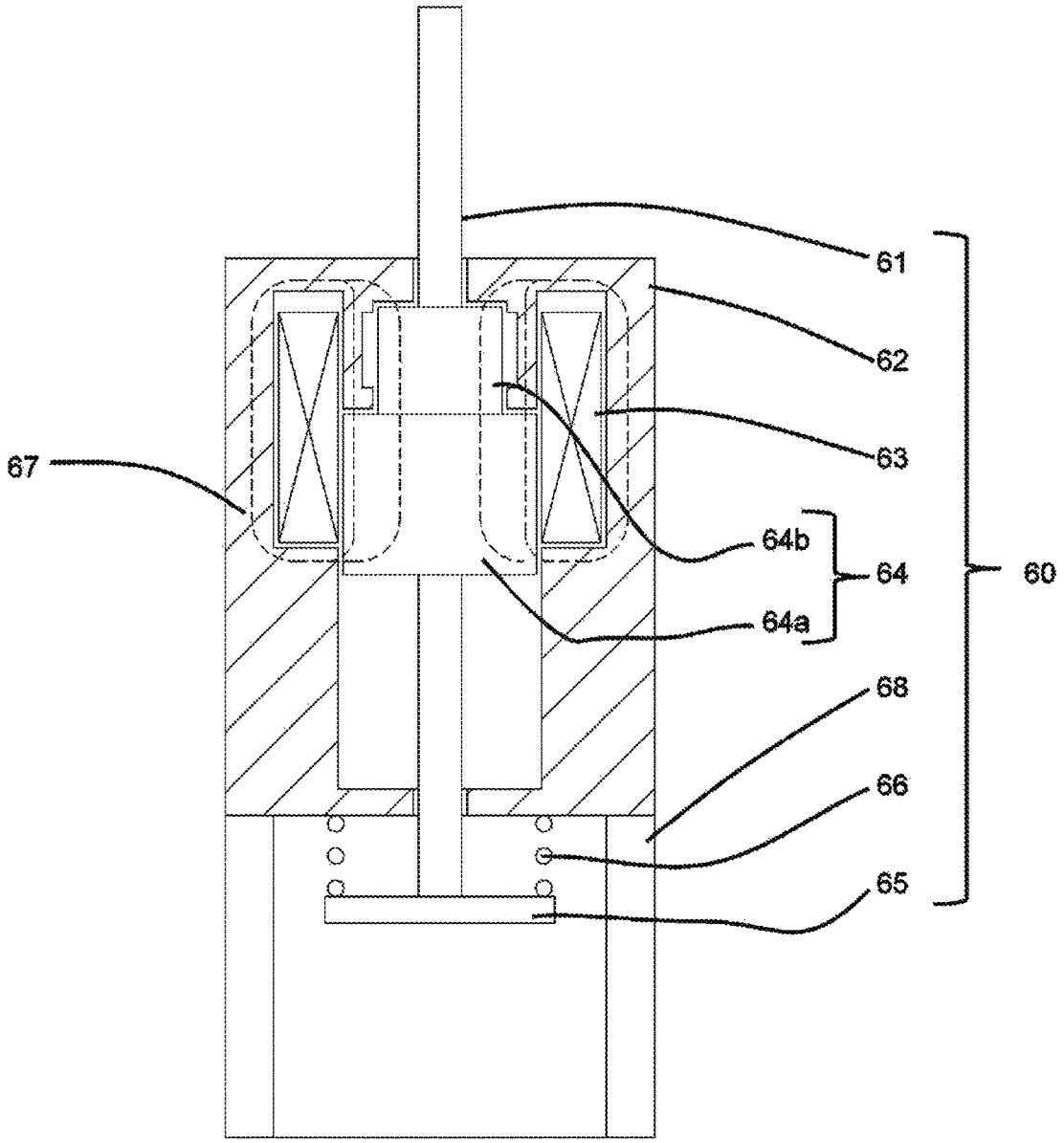
FIG. 7 is a sectional view illustrating a circuit-closing position of the second electromagnetic solenoid of the switchgear operating mechanism according to the first embodiment.

Next, the second electromagnetic solenoid 60 as a representative electromagnetic solenoid is illustrated in FIGS. 6 and 7. FIG. 6 is a structural diagram illustrating the second electromagnetic solenoid 60 kept in a circuit-opening position. FIG. 7 is a structural diagram illustrating the second electromagnetic solenoid 60 kept in a circuit-closing position. The second electromagnetic solenoid 60 includes a plunger 61, a solenoid yoke 62, a solenoid coil 63, an armature 64, a spring rest 65, a return spring 66, and a support portion 68.

The solenoid yoke 62 is an external skeleton of the second electromagnetic solenoid 60 and is made of a magnetic material. The solenoid yoke 62 has an internal space. The solenoid coil 63 is disposed in an upper region of the internal space. The plunger 61 is a rod-shaped member disposed on a center axis of the solenoid yoke 62. The plunger 61 is inserted through a hole of the upper surface of the solenoid yoke 62. One end of the plunger 61 protrudes outward and makes contact with the spring retaining plate 32. Furthermore, the armature 64 is fixedly secured to a central portion of the plunger 61.

The armature 64 is a cylindrical member made of a magnetic material. The armature 64 is accommodated within an accommodation portion formed in a central region of the internal space of the solenoid yoke 62 so that the armature 64 can move in the axial direction of the plunger 61. The outer diameter of the armature 64 is smaller than the inner diameter of the solenoid coil 63. The armature 64 is installed so as to move into and out of the solenoid coil 63.

The armature 64 of the second electromagnetic solenoid 60 is composed of two cylinders having different diameters. The lower portion of the armature 64 is a cylindrical first armature 64*a* having a large diameter. The upper portion of the armature 64 is a cylindrical second armature 64*b* having a small diameter, which is fixedly secured to the first armature 64*a*. A cylindrical protrusion portion 62*b* is formed inside the upper bottom surface of the solenoid yoke 62 at the inner side of the solenoid coil 63. The inner diameter of the protrusion portion 62*b* is a little larger than the outer diameter of the second armature 64*b*. Thus, as illustrated in FIG. 7, the second armature 64*b* can move into the protrusion portion 62*b*. However, the first armature 64*a* cannot move into the protrusion portion 62*b*.

Furthermore, the other end of the plunger 61 is inserted through a hole of the bottom surface of the solenoid yoke 62 so as to protrude outwards and is fixedly secured to the spring rest 65. The spring rest 65 is a disc-shaped member coaxial with the plunger 61. The return spring 66 is disposed between the spring rest 65 and the solenoid yoke 62 so as to surround the plunger 61. The return spring 66 has a spring force which biases the plunger 61 in such a direction as to move the plunger 61 toward the spring rest 65. Furthermore, the support portion 68 is a tubular member which accommodates the plunger 61 and the return spring 66. The upper end of the support portion 68 is fixedly secured to the lower end of the solenoid yoke 62. The lower end of the support portion 68 is fixedly installed on the inner bottom of the support frame 31.

When a current flows through the solenoid coil 63, the armature 64 of the second electromagnetic solenoid 60 is excited. As illustrated in FIG. 6, the attraction surface 64*c* of the upper portion of the armature 64 is moved toward the protrusion portion 62*b* by the electromagnetic force generated between the attraction surface 64*c* and the protrusion portion 62*b* of the solenoid yoke 62. Magnetic paths 67 formed at this time are indicated by broken lines. If the armature 64 is moved, the attraction surface 64*c* adheres to the attraction surface 62*a* of the solenoid yoke 62. Thus, the armature 64 stops. Magnetic paths 67 formed at this time are indicated in FIG. 7. If a current is not supplied, the armature 64 is moved to a pre-excitation position by the spring force of the return spring 66 as illustrated in FIG. 6.

Figure 8:
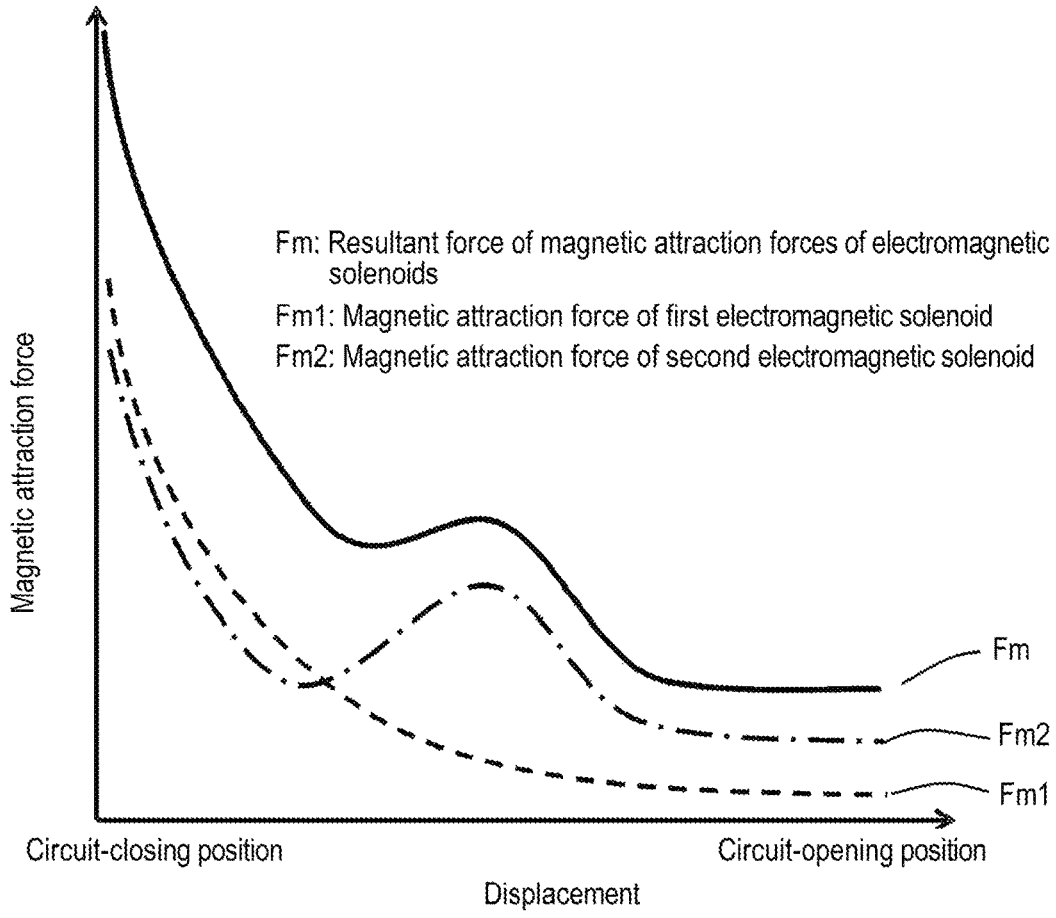
FIG. 8 is an explanatory view illustrating the relationship between a displacement and a magnetic attraction force of the electromagnetic solenoid of the switchgear operating mechanism according to the first embodiment.

The relationship between a displacement and a magnetic attraction force of each of the first electromagnetic solenoid 50 and the second electromagnetic solenoid 60 described above is illustrated in FIG. 8. In FIG. 8, the horizontal axis indicates the displacement of each of the electromagnetic solenoids and the vertical axis indicates the magnetic attraction force of each of the electromagnetic solenoids. The broken line Fm1 in FIG. 8 indicates the characteristics of the magnetic attraction force of the first electromagnetic solenoid 50. The single-dot chain line Fm2 in FIG. 8 indicates the characteristics of the magnetic attraction force of the second electromagnetic solenoid 60. The solid line Fm in FIG. 8 indicates the characteristics of the resultant force of the magnetic attraction force of the first electromagnetic solenoid 50 and the magnetic attraction force of the second electromagnetic solenoid 60. The left side of the horizontal axis indicates the circuit-closing position of the electromagnetic solenoid. The right side of the horizontal axis indicates the circuit-opening position of the electromagnetic solenoid.

Referring to FIG. 8, in case of Fm1 in the circuit-opening position, the magnetic attraction force is small because the attraction surface 54*a* and the attraction surface 52*a* are far away from each other. However, as the attraction surface 54*a* and the attraction surface 52*a* come close to each other, the magnetic attraction force increases exponentially. In contrast, in case of Fm2, the magnetic attraction force of the second electromagnetic solenoid 60 becomes larger than that of the first electromagnetic solenoid 50 because, in the circuit-opening position, the attraction surface 64*c* and the protrusion portion 62*b* is closer than the distance between the attraction surfaces 54*a* and 52*a* of the first electromagnetic solenoid 50.

When the attraction surface 64*c* and the protrusion portion 62*b* further come close to each other and come to a substantially contacting position, the electromagnetic attraction force reaches a first peak value. If the attraction surface 64*c* comes close to the attraction surface 62*a*, the magnetic paths 67 are formed in the direction of the protrusion portion 62*b* and are also formed between the attraction surface 64*c* and the attraction surface 62*a*. Thus, the electromagnetic attraction force grows larger. Fm corresponds to the resultant force available when the first electromagnetic solenoid 50 and the second electromagnetic solenoid 60 are simultaneously excited. This indicates that, if the two electromagnetic solenoids are used in combination, a large electromagnetic attraction force is obtained even in the state close to the circuit-opening position.

[Action]

Figure 3:
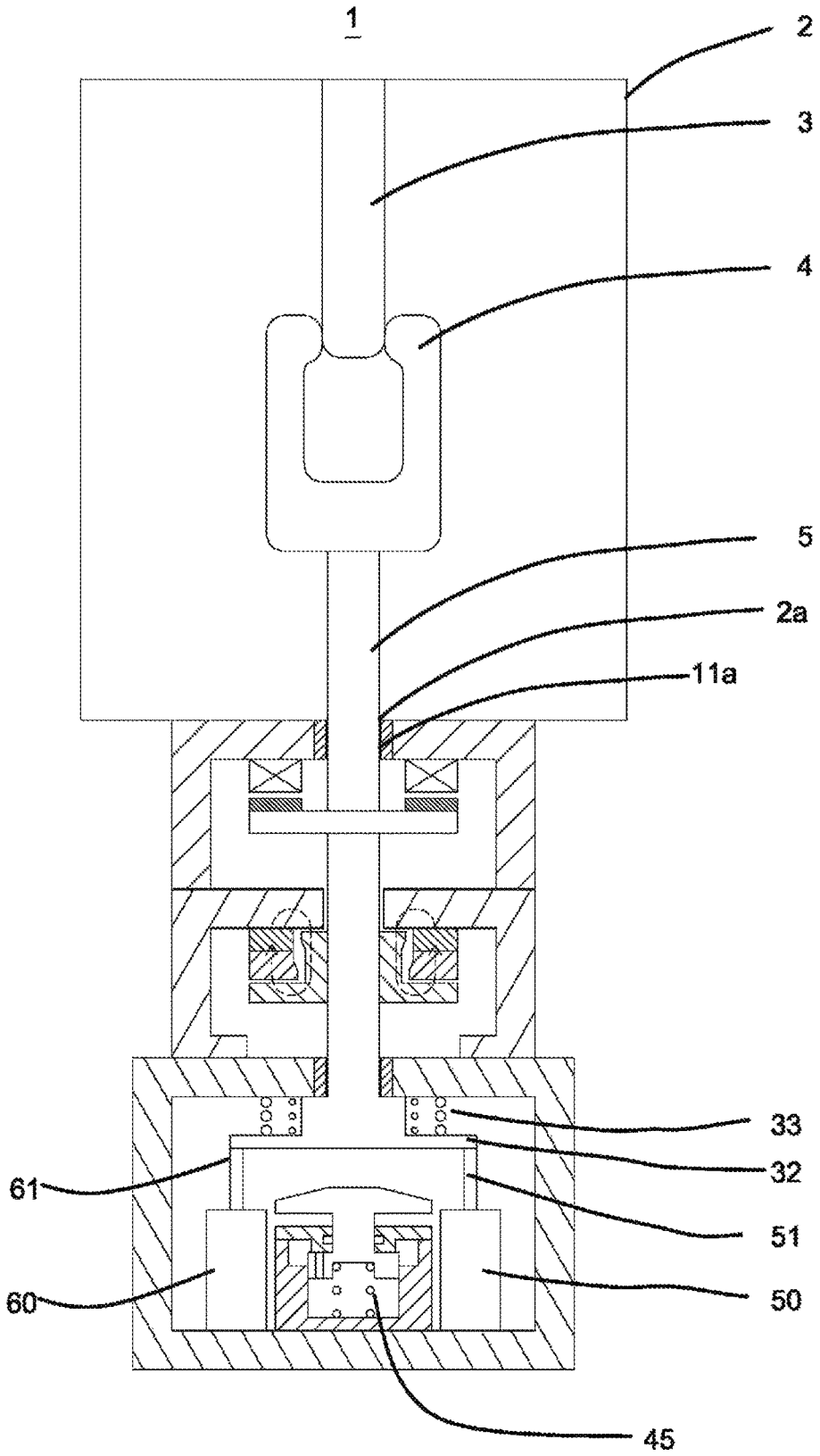
FIG. 3 is a sectional view illustrating a state in which a circuit-closing operation of the switchgear operating mechanism according to the first embodiment is underway.

The action of the present embodiment will be described with reference to FIGS. 1 to 3. In the following description, the group of members moving together with the movable shaft 5 will be referred to as a movable unit.

[Circuit-Opening Operation]

First, a description will be made on the circuit-opening operation in which the operating mechanism of the switchgear 1 is shifted from the closed circuit state illustrated in FIG. 1 to the open circuit state illustrated in FIG. 2. In the closed circuit state illustrated in FIG. 1, if a pulse current is allowed to flow from a drive power source not illustrated to the rebound coil 12, magnetic fields are generated between the rebound coil 12 and the rebound ring 13. Thus, an eddy current is generated in the rebound ring 13.

Since the eddy current flows in the opposite direction to the current which flows through the rebound coil 12, an electromagnetic rebound force is generated. The electromagnetic rebound force is larger than the magnetic force of the magnetic latch unit 20. Therefore, the rebound ring 13, the reinforcing plate 14 and the movable shaft 5 begin to move toward the damper unit 40. If the movable unit including the movable shaft 5 is displaced a specified distance, the spring retaining plate 32 makes contact with the piston head 46.

At this time point, the inertial force of the movable unit and the spring force of the circuit-opening spring 33 acts on the piston head 46. Therefore, the piston 43 is pushed inward in the circuit-opening operation direction. Then, a brake force is generated in the damper unit 40, thereby stopping the movable unit as a whole. By the foregoing operation, the movable electrode 4 is moved away from the fixed electrode 3, whereby an insulating distance is secured between the movable electrode 4 and the fixed electrode 3.

[Circuit-Closing Operation]

Next, a description will be made on the circuit-closing operation in which the operating mechanism of the switchgear 1 is shifted from the open circuit state illustrated in FIG. 2 to the closed circuit state illustrated in FIG. 1 through the circuit-closing operation ongoing state illustrated in FIG. 3. In the open circuit state illustrated in FIG. 2, if an external command (power supply) is inputted to the first electromagnetic solenoid 50 and the second electromagnetic solenoid 60, the solenoid coils 53 and 63 are excited.

By the electromagnetic force generated at this time, the armatures 54 and 64 begin to move in the circuit-closing operation direction. As illustrated in FIG. 3, the plungers 51 and 61 make contact with the spring retaining plate 32, and then move the movable unit in the circuit-closing direction while compressing the circuit-opening spring 33. When the movable yoke 24 is displaced a specified distance, the movable yoke 24 is attracted toward the fixing yoke 21 by the magnetic attraction force of the permanent magnet 22. Thereafter, the external command inputted to the first electromagnetic solenoid 50 and the second electromagnetic solenoid 60 is cut off. As illustrated in FIG. 1, the armatures 54 and 64 are returned to the circuit-opening position by the return springs 56 and 66. The plungers 51 and 61 are moved away from the spring retaining plate 32. Thus, the circuit-closing operation is completed.

[Effects]

According to the present embodiment described above, it is not necessary to install a heavy member such as a coil or the like on the movable shaft 5. This may make it possible to reduce the electric energy required in driving and to prevent the reduction in the responsiveness and the speed. That is to say, the rebound coil 12 of the electromagnetic rebound mechanism unit 10 is fixedly secured to the rebound fixing member 11. Only the rebound ring 13 and the reinforcing plate 14 are fixedly secured to the movable shaft 5. Thus, the movable unit becomes lightweight. Particularly, the rebound ring 13 is thin and the reinforcing plate 14 may be made of a lightweight material. It is therefore easy to reduce the weight. Furthermore, the magnetic latch unit 20 makes use of the permanent magnet 22 and the latch ring 23 fixedly secured to the fixing yoke 21. Thus, it is not necessary to install a coil in the movable yoke 24 fixedly secured to the movable shaft 5. This may make it possible to reduce the weight of the movable unit.

Furthermore, the movable yoke 24 of the magnetic latch unit 20 is formed to have a hat-shaped cross section. There is no need to install a coil in the head top portion 24*b* of the movable yoke 24. It may therefore be possible to increase the area of the head top portion 24*b* which comes close to the attraction surface 21*a* of the fixing yoke 21. This may make it possible to prevent the reduction in the magnetic attraction force. Particularly, in the open circuit state, the edge portion 23*a* of the latch ring 23 and the edge portion of the head top portion 24*b* are allowed to come close to each other. Therefore, as compared with the case where the entire inner wall of the latch ring 23 and the entire outer wall of the head top portion 24*b* are allowed to come close to each other, it may be possible to prevent the increase in the weight and to secure the magnetic attraction force.

Furthermore, the impulsive force generated during the stoppage of the operation is absorbed by the spring drive unit 30. It may therefore be possible to prevent the reduction in the strength of the respective parts. Particularly, the circuit-opening spring 33 of the spring drive unit 30 is used as an auxiliary drive source. Therefore, even if the stroke is relatively long, it may be possible to continuously apply a driving force and to suppress the reduction in the speed. Moreover, the use of the magnetic latch unit 20 eliminates the time delay otherwise required in releasing the spring force of the circuit-opening spring 33. Thus, the responsiveness is improved.

Since the damper unit 40 for stopping the circuit-opening operation is separated from the movable shaft 5 to become an independent body, it may be possible to reduce the weight of the movable unit. Thus, the reduction in the responsiveness and the speed becomes smaller. Particularly, the electromagnetic solenoids 50 and 60 serving as the drive sources of the circuit-closing operation are separated from the movable shaft 5. Thus, the weight of the movable unit decreases and the reduction in the responsiveness and the speed becomes smaller.

Furthermore, different kinds of electromagnetic solenoids differing in magnetic attraction force characteristics are combined as the electromagnetic solenoids 50 and 60. Thus, even in the circuit-opening position, it may be possible to obtain a sufficient attraction force and to increase the responsiveness and the speed.

By setting the magnetic attraction force of the magnetic latch unit 20 and the elastic force of the circuit-opening spring 33, it may be possible to secure an electromagnetic force at an initial stage of the circuit-closing operation without incurring the increase in the weight of the movable shaft 5 which may otherwise be incurred by the enlargement of a coil. Thus, the responsiveness and the speed during the circuit-opening operation are improved. In addition, it is not necessary to use a movable coil. By setting the magnetic attraction force of the magnetic latch unit 20, the elastic force of the circuit-opening spring 33 and the elastic force of the return spring 45, it may be possible to obtain an appropriate brake force without increasing the size of the drive power source.

Second Embodiment

Figure 9:
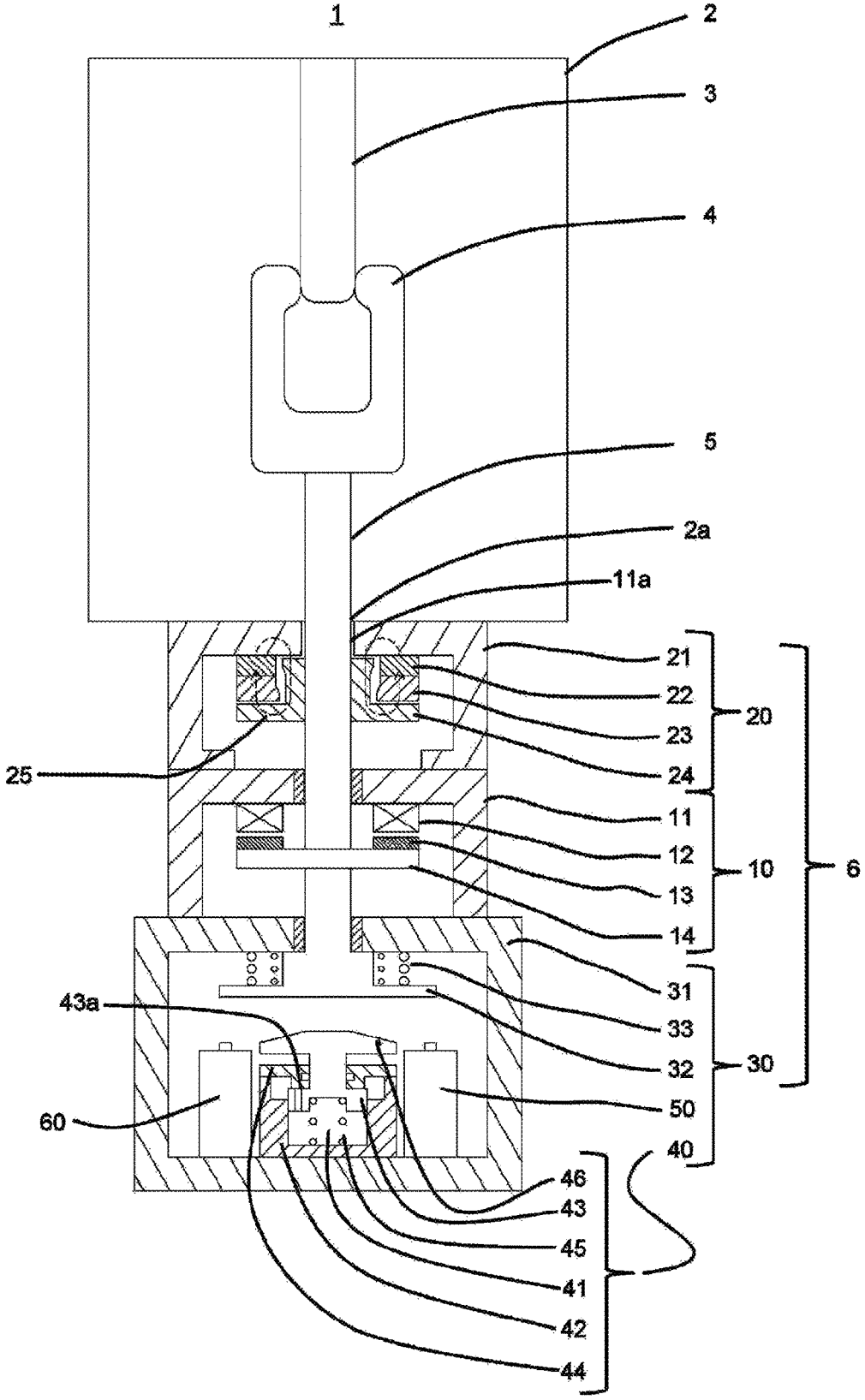
FIG. 9 is a sectional view illustrating a closed circuit state of a switchgear operating mechanism according to a second embodiment.

A switchgear operating mechanism according to a second embodiment will be described with reference to FIG. 9. FIG. 9 illustrates a closed circuit state of the switchgear operating mechanism according to the present embodiment. Parts identical with or similar to those of the first embodiment are designated by like reference symbols. A duplicate description thereof will be omitted.

The present embodiment has essentially the same configuration as the configuration of the aforementioned embodiment. However, in the present embodiment, as illustrated in FIG. 9, the position of the electromagnetic rebound mechanism unit 10 of the operating mechanism 6 is interchanged with the position of the magnetic latch unit 20.

More specifically, the positions of the rebound fixing member 11 and the fixing yoke 21*as* fixing members are reversed. Thus, the fixing yoke 21 is fixedly installed on the pressure container 2, and the rebound fixing member 11 is fixedly installed on the fixing yoke 21. The support frame 31 is fixedly installed on the rebound fixing member 11. The electromagnetic rebound mechanism unit 10 including the rebound fixing member 11 and the magnetic latch unit 20 including the fixing yoke 21 are merely interchanged with each other in the up-down direction. The configurations thereof are similar to those of the aforementioned embodiment.

Even in the present embodiment, the same operation as that of the first embodiment is performed. The action of the present embodiment is also similar to that of the first embodiment. That is to say, the arrangement positions of the electromagnetic rebound mechanism unit 10 and the magnetic latch unit 20 are not limited to those of the first embodiment.

Other Embodiments

While some embodiments of the present disclosure have been described above, these embodiments are presented by way of example and are not intended to limit the scope of the present disclosure. These embodiments may be implemented in many other forms. Various omissions, substitutions and modifications may be made without departing from the spirit of the present disclosure. These embodiments and modifications thereof are included in the scope and spirit of the present disclosure and are also included in the present disclosure recited in the claims and the scope equivalent thereto.

EXPLANATION OF REFERENCE NUMERALS

1: switchgear, 2: pressure container, 2*a*: airtight hole, 3: fixed electrode, 4: movable electrode, 5: movable shaft, 6: operating mechanism, 10: electromagnetic rebound mechanism unit, 11: rebound fixing member, 11*a*: sliding hole, 12: rebound coil, 13: rebound ring, 14: reinforcing plate, 20: magnetic latch unit, 21: fixing yoke, 21*a*: attraction surface, 21*b*: protrusion portion, 22: permanent magnet, 23: latch ring, 23*a*: edge portion, 24: movable yoke, 24*a*: brim portion, 24*b*: head top portion, 25: closed-circuit-side magnetic circuit, 25*a*: air gap, 26: open-circuit-side magnetic circuit, 26*a*: air gap, 30: spring drive unit, 31: support frame, 32: spring retaining plate, 33: circuit-opening spring, 40: damper unit, 41: hydraulic oil, 42: cylinder, 43: piston, 43*a*: orifice hole, 44: seal plate, 45: return spring, 46: piston head, 50: first electromagnetic solenoid, 51: plunger, 52: solenoid yoke, 52*a*: attraction surface, 53: solenoid coil, 54: armature, 54*a*: attraction surface, 55: spring rest, 56: return spring, 57: magnetic path, 58: support portion, 60: second electromagnetic solenoid, 61: plunger, 62: solenoid yoke, 62*a*: attraction surface, 62*b*: protrusion portion, 63: solenoid coil, 64: armature, 64*a*: first armature, 64*b*: second armature, 64*c*: attraction surface, 65: spring rest, 66: return spring, 67: magnetic path, 68: support portion

What is claimed is:

1. A switchgear operating mechanism which operates a movable shaft extending from a movable electrode of a switchgear to thereby bring the movable electrode into contact or out of contact with a fixed electrode, comprising:

an electromagnetic rebound mechanism unit;

a magnetic latch unit; and a spring drive unit, wherein the electromagnetic rebound mechanism unit and the magnetic latch unit are fixedly installed between the switchgear and the spring drive unit by virtue of a fixing member, the electromagnetic rebound mechanism unit includes a rebound coil fixedly secured to the fixing member, a reinforcing plate fixedly secured to the movable shaft and a rebound ring fixedly secured to the reinforcing plate, the magnetic latch unit includes a permanent magnet fixedly secured to the fixing member, a latch ring fixedly secured to the permanent magnet and a movable yoke fixedly secured on the movable shaft, and the spring drive unit includes a support frame fixedly installed on the fixing member, a spring retaining plate fixedly secured to an end portion of the movable shaft, a circuit-opening spring disposed between the spring retaining plate and the support frame so as to surround the movable shaft, a damper unit fixedly installed on the support frame and an electromagnetic solenoid fixedly installed on the support frame.

2. The switchgear operating mechanism of claim 1, wherein the permanent magnet and the latch ring of the magnetic latch unit are formed in an annular shape so as to have a rectangular cross section and are disposed coaxially with the movable shaft, the permanent magnet includes axially opposite end surfaces respectively magnetized with an N-pole and an S-pole, the movable yoke is formed in a hat-shaped cross section so as to have a brim portion and a head top portion, when the fixed electrode and the movable electrode make contact with each other to close the switchgear, the brim portion of the movable yoke and the latch ring come close to each other and the head top portion and the fixing member come close to each other to form a closed-circuit-side magnetic circuit so that the movable yoke and the fixing member are attracted by a magnetic force of the permanent magnet, and when the movable electrode is moved away from the fixed electrode to open the switchgear, the brim portion of the movable yoke and the fixing member come close to each other and an edge portion of the head top portion and an edge portion of the latch ring come close to each other to form an open-circuit-side magnetic circuit so that the movable yoke is attracted toward the latch ring by the magnetic force of the permanent magnet.

3. The switchgear operating mechanism of claim 1, wherein the damper unit of the spring drive unit includes a cylinder having an internal space filled with a fluid and a piston slidably disposed in the cylinder, a seal plate for hermetically sealing the fluid and restricting a movable extent of the piston is fixedly secured to one end portion of the cylinder, an orifice hole is formed in the piston, a return spring which biases the piston toward the seal plate is disposed between the piston and the cylinder within the cylinder, a piston head is fixedly secured to an end portion of the piston protruding out of the cylinder, the piston head and the seal plate are configured to make contact with each other, when moved in a direction in which the return spring is compressed, so as to restrict the movable extent of the piston, and when the movable electrode is moved away from the fixed electrode to enable the switchgear to perform a circuit-opening operation, the spring retaining plate and the piston head make contact with each other and the piston is pushed into inside of the cylinder by a spring force of the circuit-opening spring and an inertial force of a unit including the movable shaft such that a brake force is generated to stop movement of the movable electrode and the movable shaft.

4. The switchgear operating mechanism of claim 1, wherein the electromagnetic solenoid of the spring drive unit includes a plurality of electromagnetic solenoids disposed around the damper unit, and when electric power is supplied together with a circuit-closing command during a circuit-closing operation of the switchgear, an end portion of a plunger of the electromagnetic solenoid makes contact with the spring retaining plate and moves the movable electrode toward the fixed electrode until the magnetic latch unit reaches a circuit-closing position.

5. The switchgear operating mechanism of claim 1, wherein a plurality of electromagnetic solenoids differing in magnetic attraction force characteristics is disposed around the damper unit.

6. The switchgear operating mechanism of claim 3, wherein when the switchgear is in a closed circuit state, a magnetic attraction force Fmc of the magnetic latch unit and an elastic force Fkc of the circuit-opening spring are set to satisfy a relationship of Fmc>Fkc, and when the switchgear is in an open circuit state, a magnetic attraction force Fmo of the magnetic latch unit, an elastic force Fko of the circuit-opening spring and an elastic force Fdo of the return spring of the damper unit are set to satisfy a relationship of Fko>(Fmo+Fdo).

* * * * *